US007463252B2

(12) United States Patent
Mas et al.

(10) Patent No.: US 7,463,252 B2
(45) Date of Patent: Dec. 9, 2008

(54) IMAGE DISPLAY ON AN ARRAY SCREEN

(75) Inventors: Céline Mas, Poisat (FR); Eric Benoit, Quaix en Chartreuse (FR); Olivier Scouarnec, Saint Nazaire les Eymes (FR); Olivier Le Briz, Saint-Gervais (FR)

(73) Assignee: STMicroelectronics S.A., Montrouge (FR)

( * ) Notice: Subject to any disclaimer, the term of this patent is extended or adjusted under 35 U.S.C. 154(b) by 232 days.

(21) Appl. No.: 10/622,417

(22) Filed: Jul. 18, 2003

(65) Prior Publication Data

US 2004/0021654 A1 Feb. 5, 2004

(30) Foreign Application Priority Data

Jul. 19, 2002 (FR) ..... 02 09229

(51) Int. Cl.
*G09G 5/00* (2006.01)
*G09G 3/20* (2006.01)
*G06F 12/00* (2006.01)

(52) U.S. Cl. ..... 345/204; 345/55; 345/564

(58) Field of Classification Search ..... 345/530, 345/531, 534, 545, 547, 556, 559, 564, 565, 345/566, 571, 572, 30, 33, 44, 46, 48, 51, 345/55, 204, 90, 98, 100, 473–475, 535
See application file for complete search history.

(56) References Cited

U.S. PATENT DOCUMENTS 5,594,463 A 1/1997 Sakamoto
5,613,048 A * 3/1997 Chen et al. ..... 345/419
5,726,679 A 3/1998 Kanno et al.
5,754,157 A * 5/1998 Kuwata et al. ..... 345/100
5,900,887 A * 5/1999 Leung et al. ..... 345/531
5,929,831 A 7/1999 Aratani et al.
6,359,654 B1 * 3/2002 Glennon et al. ..... 348/448
6,414,689 B1 * 7/2002 Wu ..... 345/558
6,545,740 B2 * 4/2003 Werner ..... 352/50
6,756,976 B2 * 6/2004 Richards ..... 345/204
6,806,854 B2 * 10/2004 Cairns et al. ..... 345/87

(Continued)

OTHER PUBLICATIONS

French Search Report from French Patent Application 02/09229, filed Jul. 19, 2002.
French Search Report from French Patent Application 02/09228, filed Jul. 19, 2002.
French Search Report from French Patent Application 02/09227, filed Jul. 19, 2002.

(Continued)

*Primary Examiner*—Kee M Tung
*Assistant Examiner*—Joni Hsu
(74) *Attorney, Agent, or Firm*—Lisa K. Jorgenson; James H. Morris; Wolf, Greenfield & Sacks, P.C.

(57) ABSTRACT

A method and circuit for displaying an image by activation of pixels of an array screen based on an image stored in digital form in memory point rows of a frame memory, having a stand-by mode that provides, at a frequency proportional to the display frequency, a cyclic succession of offset values; and for each row address of the frame memory, activating pixels of a screen line associated with said address offset by a same offset value based on the read states of the row associated with the address, and/or activating pixels of a screen line associated with the row address based on the read states of the frame memory row associated with the address offset by a same offset value.

5 Claims, 3 Drawing Sheets

U.S. PATENT DOCUMENTS

| | | | | |
|---|---|---|---|---|
| 6,937,224 | B1 * | 8/2005 | Miyachi | 345/102 |
| 6,976,180 | B2 * | 12/2005 | Cupps et al. | 713/300 |
| 2001/0026285 | A1 | 10/2001 | Toffolo et al. | |
| 2001/0043206 | A1 | 11/2001 | Naito et al. | |
| 2002/0180673 | A1 * | 12/2002 | Tsuda et al. | 345/87 |
| 2003/0076332 | A1 * | 4/2003 | Choi | 345/581 |

OTHER PUBLICATIONS

Patent Abstracts of Japan vol. 2000, No. 15, Apr. 6, 2001 & JP 2000 347613 A (Mitsubishi Electric Corp.).

Patent Abstracts of Japan, vol. 2000, No. 01, Jan. 31, 2000 & JP 11 272223 A (Toyota Motor Corp.).

* cited by examiner

IMAGE DISPLAY ON AN ARRAY SCREEN

BACKGROUND OF THE INVENTION

1. Field of the Invention

The present invention relates to a method and a device for displaying images on an array screen by activation of screen pixels arranged in rows and columns.

2. Discussion of the Related Art

The present invention especially applies to array screens in which each pixel is formed of a light-emitting diode, for example, of organic or polymer nature (screen of OLED type, for Organic Light-Emitting Display or of PLED type, for Polymer Light-Emitting Display). The cathodes of the diodes of a same row are connected to a row electrode and the anodes of the diodes of a same column are connected to a column electrode.

FIG. 1 shows an example of a conventional device for displaying an image on an array screen.

In the present example, the image is displayed on a screen 10 in the form of a single frame. Each pixel 12 is then associated with a memory point 14 of a frame memory 16, for example, a RAM. Memory points 14 are arranged in Y rows and in X columns and may be set to state 0 or to state 1 via a writing interface 18 which receives data to be written WDATA as well as addresses WADDRESS of these data. Writing interface 18 is controlled by a write clock signal WCLK. The image to be displayed on screen 10 is previously stored in digital form in frame memory 16. As an example, a memory point 14 is set to 1 when the corresponding pixel 12 of screen 10 is to be on, and set to 0 otherwise.

Upon normal operation of the display device, the image stored in frame memory 16 is displayed on screen 10 at the frequency of a frame clock signal FCLK. The states of all the memory points 14 of a row may be read by a reading interface 20. Reading interface 20 receives at the frequency of a read clock signal RCLK an address signal RADDRESS provided by an address counter 22 which indicates the row of frame memory 16 to be read. Reading interface 20 then provides a column driver 23 with data RDATA, for example in the form of X bits, which represent the states of memory points 14 of address row RADDRESS. A row driver 24 also receives an address signal ADDRESS, for example, in the form of Y bits, corresponding to the image of address RADDRESS by a decoder 26 and which enables activation of the row of screen 10 associated with address row RADDRESS of frame memory 16. Column driver 23 then activates or not the pixels 12 of the activated line according to data RDATA. As an example, the pixels activated in FIG. 1 are shown by crosses 27.

In certain applications, especially for portable phone or electronic diary screens, the image stored in frame memory 16 may not be modified upon display of many successive frames. Certain pixels 12 of screen 10 are then activated and others are off for many successive frames. This result in an uneven aging of pixels 12 of screen 10.

To avoid uneven aging of the screen pixels, different successive images are attempted to be displayed on screen 10 even if the image stored in frame memory 16 is fixed or varies sporadically for several successive displayed frames.

FIG. 2 shows a device for displaying images on an array screen which provides a specific operating mode, which enables displaying different successive images on the screen based on an image stored in a stand-by memory 30 which is fixed or varies sporadically.

A CPU 32, driven by the microprocessor of the display device, is adapted to reading the states of the memory points of stand-by memory 30, to determining a new image by calculating new states, and to writing the new states in frame memory 16 via writing interface 18. Based on the image stored in stand-by memory 30, CPU 32 thus determines a new image stored in frame memory 16 which will be usually read by reading interface 20 and displayed on screen 10 as has been explained previously.

In stand-by mode, the new image calculated by CPU 32 often corresponds to the image stored in stand-by memory 30 offset according to the directions of the rows and columns. According to the frequency at which CPU 32 provides new images stored in frame memory 16, a spectator can sense the image of frame memory 30 which displaces on screen 10.

A disadvantage of such a device is that the CPU must generate new images at a sufficient frequency with respect to the frequency of frame clock signal FCLK to obtain a satisfactory motion of screen 10. Thereby, the work capacities of the device microprocessor are required for the calculation of new images, which increases the work load of the microprocessor.

SUMMARY OF THE INVENTION

The present invention aims at a method and a device for displaying images on an array screen based on an image stored in a frame memory which provides a stand-by mode which enables displaying different successive images based on an image stored in the memory, which is fixed or varies sporadically and which does not use or only slightly uses the microprocessor of the display device.

To achieve this and other objects, the present invention provides a method for displaying an image by activation of pixels of an array screen based on an image stored in digital form in memory point rows of a frame memory, comprising a normal display mode comprising, for the display of a frame, the steps of: (a) providing a succession of row addresses associated with rows of the frame memory; (b) successively reading the states of memory points of the rows associated with the row addresses; and (c) activating, for each row address, pixels of a line associated with said row address based on the read states of the row associated with said address. The method comprises a stand-by mode comprises replacing step (c) with the steps of: (d) providing, by a dedicated circuit, at a frequency proportional to the display frequency, a cyclic succession of offset values; and (e) for each row address of the frame memory, activating pixels of a screen line associated with said address offset by a same offset value based on the read states of the row associated with said address, and/or activating pixels of a screen line associated with said row address based on the read states of the frame memory row associated with said address offset by a same offset value.

The present invention also provides a device for displaying an image on an array screen comprising a frame memory comprising memory points arranged in rows and in columns; a write means for storing in the frame memory an image in digital form; a read means for reading the states of the memory points of a row of the frame memory at a determined row address; a row driver for selecting a screen line based on the determined row address; and a column control circuit for activating pixels of said selected line based on the states of memory points read by the read means. The device further comprises a dedicated control circuit for providing, at a frequency proportional to the image display frequency, a cyclic succession of offset values; and a dedicated address circuit receiving the address of the row read by the read means and transmitting to the row driver a new address corresponding to the address of the read row offset by a same offset value, and/or a dedicated sate circuit receiving the states of the points read by the read means and transmitting to the column driver new states corresponding to the read states offset by a same offset value.

According to an embodiment, the dedicated state circuit is a shift register, in which are written the states of memory points provided by the read means, adapted to performing an offset by a determined number of bits on said states.

According to an embodiment, the dedicated address circuit is an adder adapted to adding the offset value to the address of the read row.

According to an embodiment, the screen is an array screen with light-emitting diodes.

The foregoing objects, features and advantages of the present invention, will be discussed in detail in the following non-limiting description of specific embodiments in connection with the accompanying drawings.

DETAILED DESCRIPTION

Figure 1:
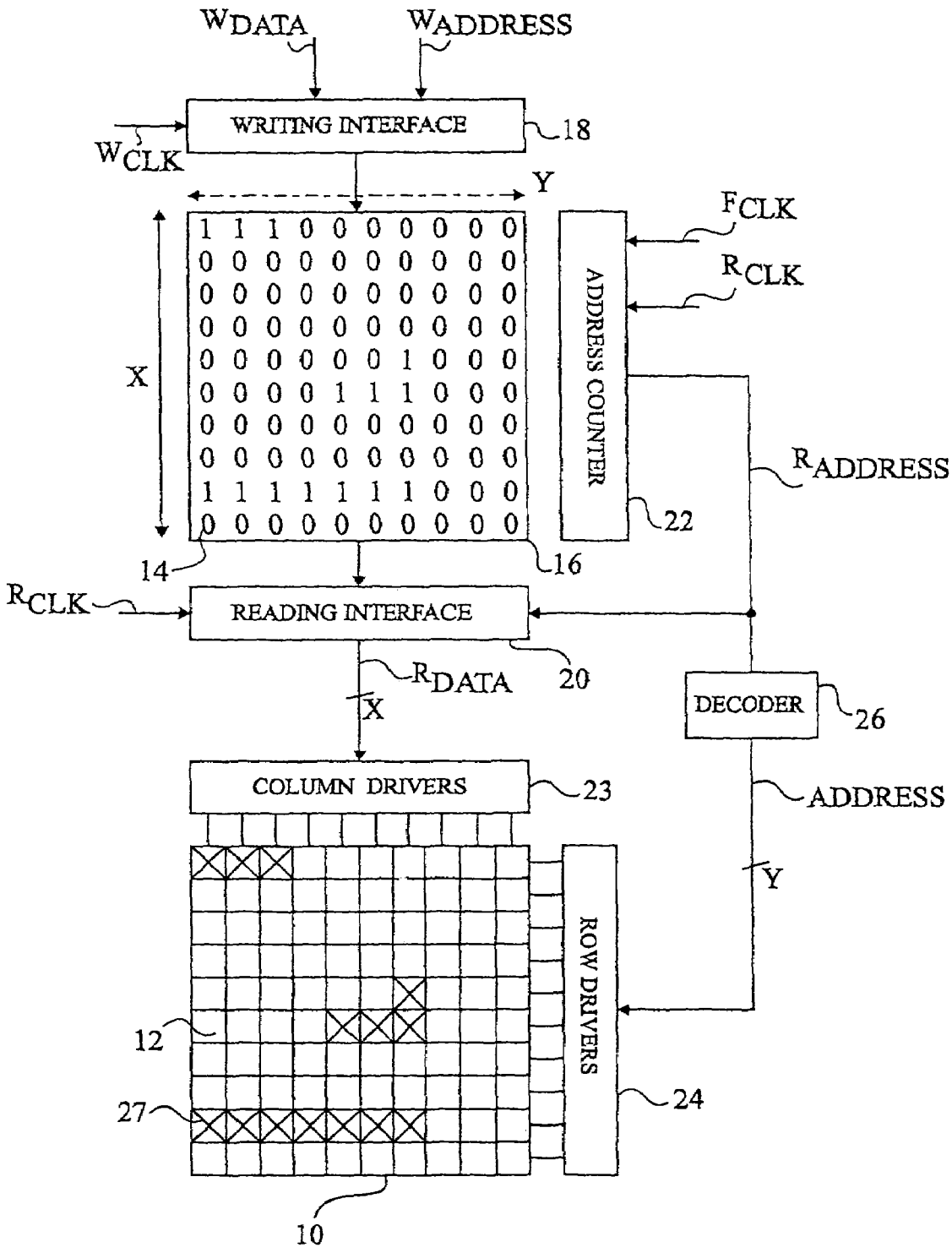
FIG. 1, previously described, shows a conventional device for displaying an image on an array screen.
Figure 2:
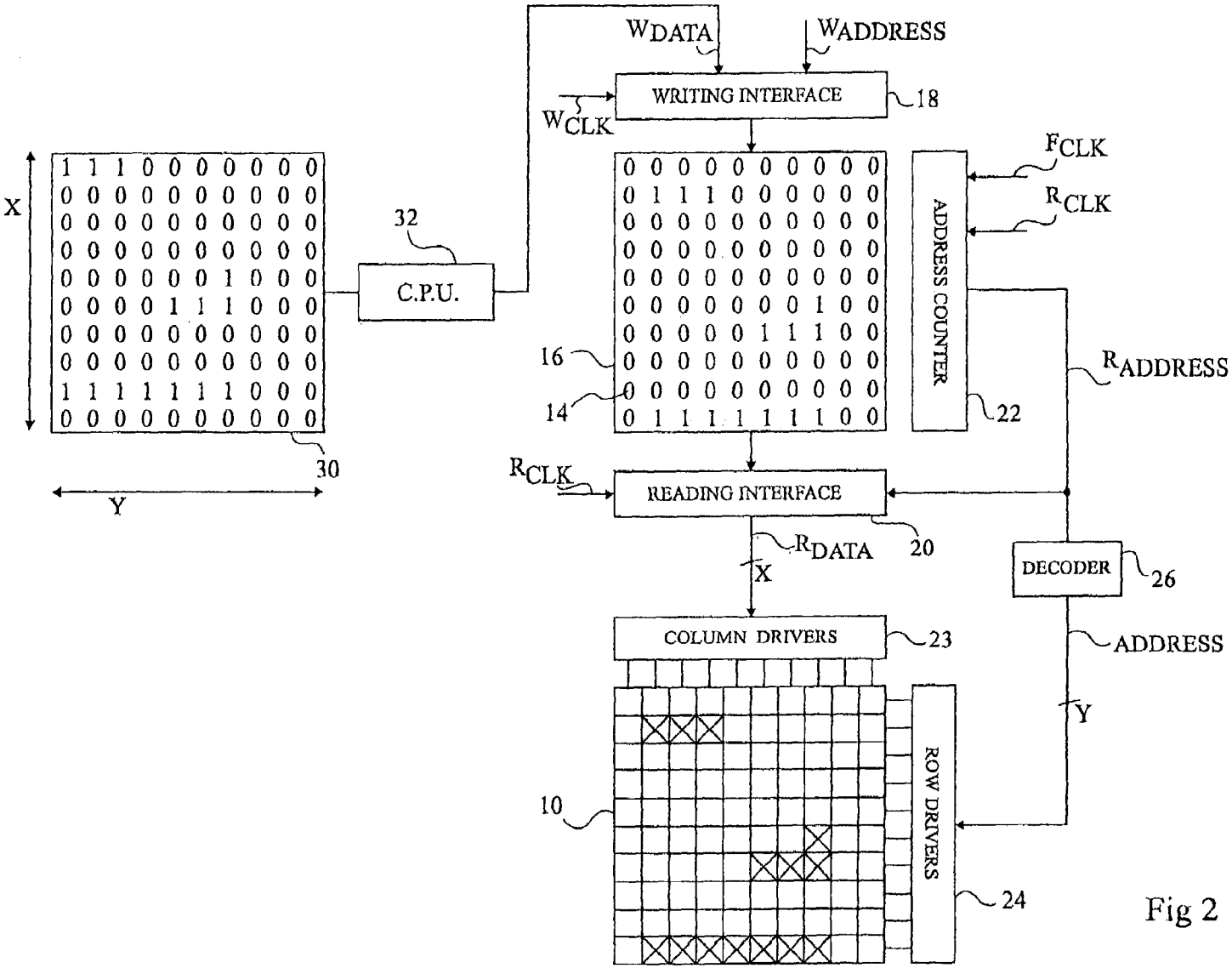
FIG. 2, previously described, shows a conventional device enabling display of different successive images on an array screen based on a substantially fixed image stored in memory.
Figure 3:
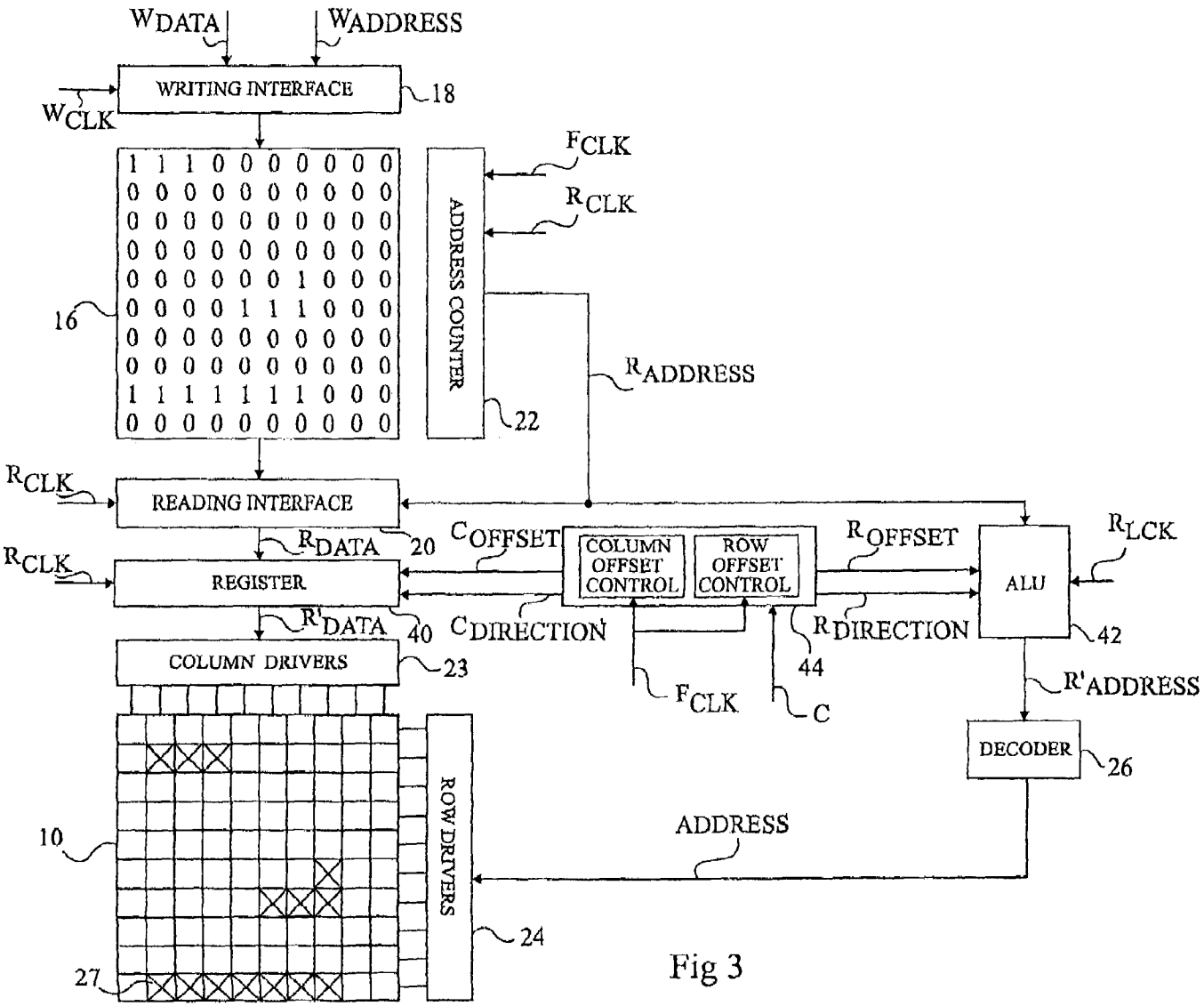
FIG. 3 shows an example of embodiment according to the present invention of a device enabling display of different successive images on an array screen based on a fixed image or a sporadically-varying image stored in memory.

The display device illustrated in FIG. 3 comprises a frame memory 16 in which an image is stored in digital form via writing interface 18. Upon display of an image, at the frequency of frame clock signal $F_{CLK}$, address counter 22 successively provides addresses $R_{ADDRESS}$ of the rows of memory 16 at the frequency of read clock signal $R_{CLK}$. As an example, an address $R_{ADDRESS}$ may comprise an integer, in binary form, varying from 1 to Y. Upon reception of the address of a row, reading interface 20 reads the states of the X memory points in the row and transmits them to a register 40 in the form of X bits at 1 or at 0. Each address $R_{ADDRESS}$ is transmitted to a logic unit 42 (ALU), formed, for example, of an adder. A row and column offset control system 44, for example, formed of a finite state machine, is connected to register 40 and to logic unit 42. Control system 44 receives a configuration signal C of the microprocessor of the display device as well as frame clock signal $F_{CLK}$.

Register 40 is an offset register adapted based on the X bits received from read interface 20 to providing X new bits to column control circuit 23. The X new bits correspond, for example, to the X old bits offset by a determined number in one direction or the other. Register 40 may be a loop-back shift register or a simple shift register. In this last case, the offset bits are completed by bits at 0. Register 40 must be able to perform the offset operation during one period of read clock signal $R_{CLK}$. At most, register 40 must thus be able to perform X offset operations in one period of read clock signal $R_{CLK}$. Control system 44 provides register 40, based on control signal C, with offset signal $R_{OFFSET}$ and direction signal $R_{DIRECTION}$ which respectively set the number of offset bits and the offset direction.

Logic unit 42 is adapted to adding or to subtracting a variation quantity to address $R_{ADDRESS}$ to obtain a new address $R'_{ADDRESS}$ provided to decoder 26. Control system 44 provides logic unit 42, based on control signal C, with offset signal $R_{OFFSET}$ and direction signal $R_{DIRECTION}$ which respectively set the value of the variation quantity and the choice between an addition or a subtraction.

System 44 respectively transmits to register 40 and to logic unit 42 the offset and direction signals at the frequency of frame clock signal $F_{CLK}$. For each row of memory 20, register 40 then performs a same offset on the read bits and logic unit 42 increments or decrements each address $R_{ADDRESS}$ by a same variation quantity. Accordingly, for each row of memory 20, the memory point states are offset and the row thus modified is displayed on screen 10 at a row offset with respect to the row normally associated with said row.

As an example, the pixels 27 activated on screen 10 in FIG. 3 correspond to a 1-bit offset of register 40 to the right and to a one-row offset by unit 42 downwards.

According to control signal C, system 44 provides new values of the offset and direction signals at the frequency of frame clock signal $F_{CLK}$ or at a multiple of this frequency. According to the frequency of such modifications, the image displayed on screen 10 may, for the same offset and direction signals, exhibit for a spectator a faster or slower general motion. The values of the offset and direction signals vary in a cyclic fashion. As an example, to obtain a general motion of the image displayed in the direction of the rows of screen 10, system 44 may provide at a first pulse of frame clock signal $F_{CLK}$ an offset signal $R_{OFFSET}$ controlling a 1-bit offset, at the next pulse of frame clock signal $F_{CLK}$ an offset signal controlling a 2-bit offset, etc. The offset and direction signals may be determined to simulate, for example, a bouncing of the image on the screen sides.

Upon normal operation of the display device, the offset and direction signals are zero, and the image displayed on screen 10 undergoes no modifications with respect to the image stored in frame memory 16. In stand-by mode, a control signal C, causing the display of moving images, may be transmitted to system 44. As an example, the stand-by mode may be initiated, in the case of a portable phone screen, in the absence of any action of the user on the telephone keyboard for a determined duration.

According to an alternative of the present invention, register 40 may perform, instead of a shifting of the received bits or in addition thereto, a modification of said bits. Logic gates (not shown) may also be associated with register 40 to perform various logic operations on the bits stored in register 40. For example, the bits stored in register 40 may be inverted at the frequency of frame clock signal $F_{CLK}$ or at a multiple of this frequency.

Upon image display according to the method of the present invention, the microprocessor of the display device only intervenes to transmit a control signal to system 44 to control the motion to be applied to the image stored in frame memory 16, or the transformation performed on the image stored in frame memory 16. Afterwards, the image processing steps will only be performed by dedicated circuits, that is, register 40, logic unit 42, or system 44 and do not require the calculating capacities of the microprocessor.

Further, the motion applied to the image stored in frame memory 16 may be such that globally all pixels 12 of screen 10 are on substantially a same number of times. An uneven aging of pixels 12 is thus avoided.

Of course, the present invention is likely to have various alterations, modifications, and improvements which will readily occur to those skilled in the art. Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method for displaying an image by activation of pixels of an array screen based on an image stored in digital form in memory point rows of a frame memory, comprising a normal display mode comprising, for the display of a frame, the steps of:

(a) providing a succession of row addresses associated with rows of the frame memory;

(b) successively reading the states of memory points of the rows associated with the row addresses; and (c) activating, for each row address, pixels of a line associated with said row address based on the read states of the row associated with said address, further comprising a stand-by mode comprising replacing step (c) with the steps of:

(d) providing, by a dedicated circuit, at a frequency proportional to the display frequency, a cyclic succession of pixel position offset values comprising a first pixel position offset value; and (e) for each row address, providing a new row address corresponding to said row address offset by the first pixel position offset value and activating pixels of a screen line associated with said new row address, based on the read states of the row associated with said row address, and/or providing new states corresponding to the read states of the memory points of the frame memory row associated with said new row address, said read states being offset by the first pixel position offset value and activating pixels of a screen line associated with said row address based on the new states.

2. A device for displaying an image on an array screen comprising:

a frame memory comprising memory points arranged in rows and in columns;

a write means for storing in the frame memory an image in digital form;

a read means for reading the states of the memory points of a row of the frame memory at a determined row address;

a row driver for selecting a screen LINE based on the determined row address; and a column driver for activating pixels of said selected line based on the states of memory points read by said read means, further comprising:

a dedicated control circuit for providing, at a frequency proportional to the image display frequency, a cyclic succession of pixel position offset values comprising a first pixel position offset value; and a dedicated address circuit receiving the address of the row read by the read means and transmitting to the row driver a new address corresponding to the address of the read row offset by the first pixel position offset value, and/or a dedicated state circuit receiving the states of the points read by the read means and transmitting to the column driver new states corresponding to the read states offset by the first pixel position offset value.

3. The device of claim 2, wherein the dedicated state circuit is a shift register, in which are written the states of memory points provided by the read means, adapted to performing an offset by a determined number of bits on said states.

4. The device of claim 2, wherein the dedicated address circuit is an adder adapted to adding the pixel position offset value to the address of the read row.

5. The device of claim 2, wherein the screen is a screen with light-emitting diodes.

* * * * *